United States Patent [19]

Haber et al.

[11] 4,124,881

[45] Nov. 7, 1978

[54] DICE WITH ILLUMINATING MEANS

[76] Inventors: Terry M. Haber, 25721 B Taladro Cir., Mission Viejo, Calif. 92691; Maurice M. Greeson, 17616 Jordan, #9C, Irvine, Calif. 92714

[21] Appl. No.: 826,355

[22] Filed: Aug. 22, 1977

[51] Int. Cl.[2] ..... F21V 33/00

[52] U.S. Cl. ..... 362/253; 362/800; 362/806

[58] Field of Search ..... 362/800, 253, 34, 806

[56] References Cited

U.S. PATENT DOCUMENTS 3,917,264 11/1975 Davidson ..... 362/84 X

*Primary Examiner*—Stephen J. Lechert, Jr.

*Attorney, Agent, or Firm*—Ralph B. Pastoriza

[57] ABSTRACT

A pair of dice each having twelve flat surfaces and in which opposite surfaces lie in parallel planes is provided. Each die incorporates twelve light emitting diodes for illuminating respectively the 12 surfaces but interconnected with a central battery by way of gravity responsive switches in such a manner that only the topmost surface of the die will be illuminated after the die has been thrown and comes to rest on a flat surface.

8 Claims, 9 Drawing Figures

DICE WITH ILLUMINATING MEANS

This invention relates generally to dice as used in games and the like and more particularly to uniquely designed dice in which illuminating means are provided for illuminating the topmost surfaces of the dice after they have been thrown and come to rest on a flat surface.

BACKGROUND OF THE INVENTION

Conventional playing dice for games and the like comprise a pair of cubes with appropriate numbers or dots indicative of a number on their six sides. The number of different combinations with such six-sided die is necessarily limited because of the limitation on the number of sides which can appear in a topmost position. However, there may be devised many games in which a far greater number of combinations than can presently be formed by known dice would be desirable.

While it is possible to form a three dimensional or solid body with as many flat faces as desired, if too many such surfaces are used, the planes of adjacent surfaces tend towards a coplanar relationship and there can be ambiguity as to precisely which face is topmost. It would clearly be desirable to eliminate such ambiguity particularly under poor lighting conditions and when the dice are viewed at an angle from the surface rather than looking straight down on the surface. In fact, even with conventional six-sided dice it might be desirable to remove any ambiguity as to which surface is topmost under extremes of the previously mentioned conditions.

Most conventional dice are identical; that is, each die making up the pair is identical to the other. There are many games that can be devised with dice wherein further variations can be realized by making one of the die of the pair having an outline for its various surfaces of a different configuration from that of the other so that each die can be distinguished from the other. However, it is also desirable that the die be of approximately the same overall size and mass and that the various faces of each die be congruent with its other faces.

BRIEF DESCRIPTION OF THE PRESENT INVENTION

With all of the foregoing considerations in mind, the present invention contemplates a novel pair of dice in which any ambiguity as to the topmost surface displayed is wholly removed.

Moreover, in accord with the preferred embodiment of the present invention, the dice include more faces than six and yet the faces of each die are congruent and opposite faces lie in parallel planes as is necessary to provide for a topmost face being exposed.

Finally, with the preferred embodiment of this invention, the two die making up the pair of dice are geometrically different so that they can be distinguished from each other even though they both have the same number of faces.

Briefly, in accord with the invention, the dice include first and second die each having a plurality of surfaces in which opposite surfaces lie in parallel planes and wherein illuminating means is incorporated in each die. Also provided are energizing means for the illuminating means in each die responsive to gravity to illuminate that surface which assumes a topmost position after the die has been thrown and comes to rest.

In the preferred embodiment, each die has twelve surfaces, the outline of the surfaces of the first die defining a rhombus and the outline of the second die surfaces defining a pentagon.

The versatility of many games can thus be greatly expanded by the use of the dice of this invention.

BRIEF DESCRIPTION OF THE DRAWINGS

A better understanding of this invention will be had by now referring to the accompanying drawings in whih.

DETAILED DESCRIPTION OF THE PREFERRED EMBODIMENT

Figure 1:
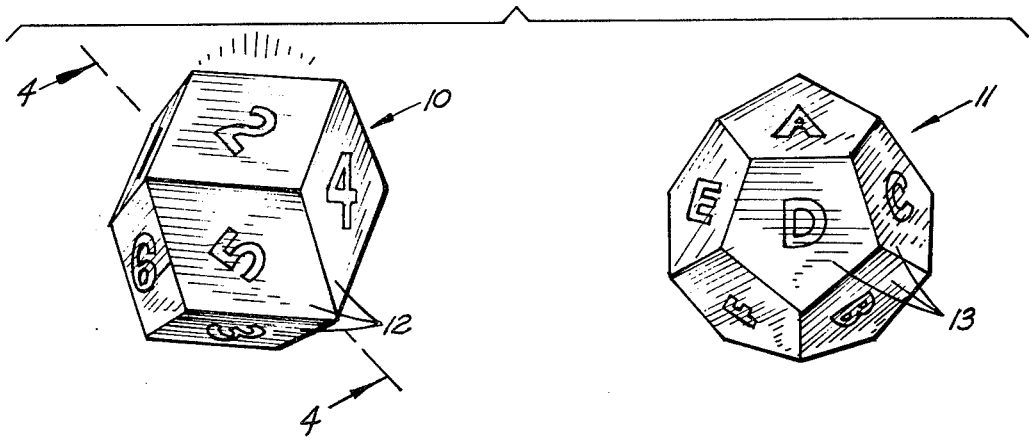
FIG. 1 is a perspective view of dice showing the preferred embodiment of this invention.

Referring first to FIG. 1, the dice are shown as including first and second die 10 and 11 each having twelve flat congruent surfaces some of which are indicated by the numerals 12 and 13 respectively. Opposite surfaces lie in parallel planes. In the particular embodiment illustrated, each die has twelve such surfaces.

Moreover, each die is distinguishable from the other notwithstanding that the same are of similar overall size and mass. Thus, the outline of each of the twelve surfaces of the first die 10 is a rhombus while the outside of each of the twelve surfaces of the second die 1 is a pentagon. In each case, each rhombus is congruent to each other rhombus in the first die and each pentagon is congruent to each other pentagon in the second die.

In the particular example illustrated in FIG. 1, the faces of the first die are designated by different numerals each of which may be defined by translucent portions of an appropriate masking surface. Similarly, each of the surfaces of the second die 11 are designated by letters which similarly may be defined by translucent portions of an appropriate masking.

Figure 2:
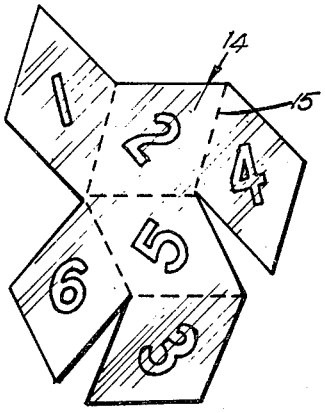
FIG. 2 is a flat plan view of a masking cut-out for defining six of the surfaces of one of the die of FIGURE 1.

Referring to FIG. 2, one half of such masking arrangement to define six of the number symbols for six surfaces of the first die 10 of FIG. 1 is shown. Thus, there is indicated at 14 a flat masking cut-out arranged to be folded along the dashed fold lines 15 to form one half of the surfaces of the first die of FIG. 1.

Figure 3:
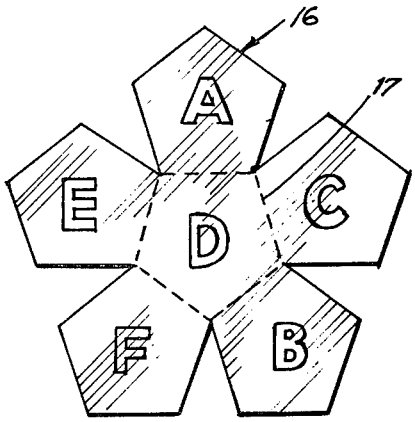
FIG. 3 is a flat plan view of a masking cut-out for defining six of the surfaces of the other of the dice of FIG. 1.

Similarly, for the second die 11 there is illustrated in FIG. 3 a masking cut-out 16 arranged to be partially folded along the dashed fold lines 17 to define six of the surfaces of the second die.

The numbers and letters of FIGS. 2 and 3 can be actual transparent portions in the mask or translucent portions, the remaining surface of the mask being opaque.

Figure 4:
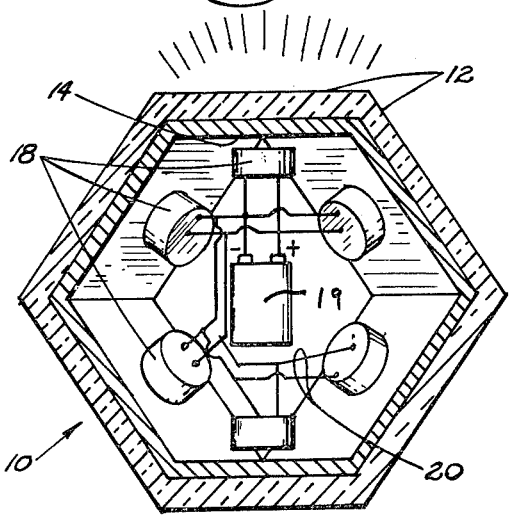
FIG. 4 is a cross section taken in the direction of the arrows 4—4 through one of the die of FIG. 1.

Referring now to the cross section of FIG. 4, it will be noted that the masking surfaces 14 are disposed immediately beneath the exterior surfaces 12 of the die 10, the surfaces 12 being a transparent or translucent plastic material. Associated with each surface is a light emitting diode there being provided twelve all together. Some of these light emitting diodes are indicated at 18 and are arranged to be illuminated by a battery schematically indicated at 19. Appropriate interconnections to the various light emitting diode structures are provided by leads 20 as shown also in schematic form in FIG. 4.

Figure 5:
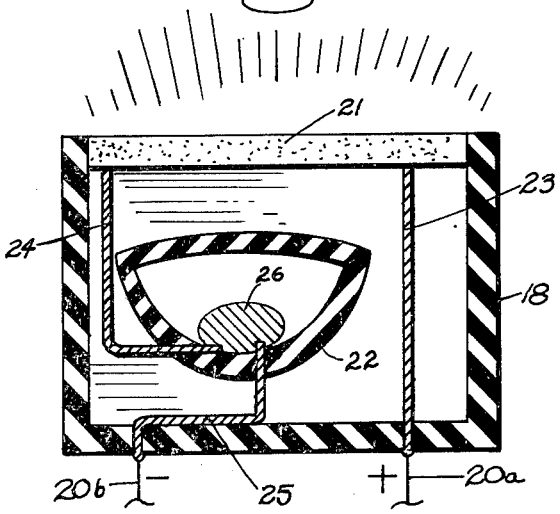
FIG. 5 is an enlarged cross section of one of the illuminating means illustrated in FIG. 4.

Referring now to FIG. 5, further details of the illuminating means will be evident. As shown, a typical one of the light emitting diodes or illuminating structures 18 is illustrated in enlarged cross section wherein the light emitting diode itself is indicated at 21 cooperating with an appropriate gravity-responsive switch such as indicated by the dished container 22. The leads for the light emitting diode are shown at 23 and 24, the lead 23 connecting to one of the leads to the battery such as the lead 20*a* and the lead 24 connecting into the dish-shaped gravity responsive switch structure 22. A further portion of the lead 24 is shown at 25 passing from the dish shaped structure 22 to the other battery lead 20*b*. The lead 24 is thus broken from the lead 25 inside the dish-shaped structure 22 but is arranged to be bridged by a globule of mercury 26 when the overall illuminating structure is level or horizontal. In other words, it will be evident that any tilting of the structure illustrated in FIG. 5 will cause the mercury globule to roll to one side or the other of the dish-shaped structure 22 thereby disconnecting the lead portions 24 and 25 and thus de-energizing the light emitting diode 21.

Since the structure shown in FIG. 5 is typical of the various illuminating means 18 illustrated in FIG. 4, it will be evident that only the topmost surface of the die will be illuminated after the die has been thrown and come to rest on a flat surface.

It will be understood that a similar illuminating means, battery and gravity responsive switch means are provided for each of the surfaces for the second die 11 of FIG. 1.

Figure 6:
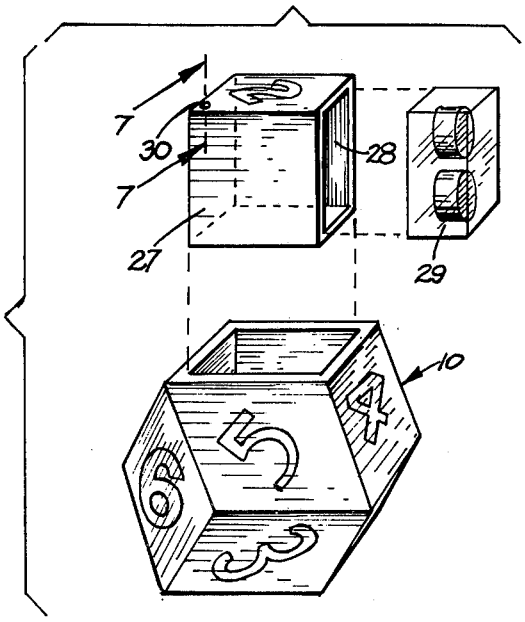
FIG. 6 is an exploded perspective view illustrating the manner in which batteries can be replaced in one of the dice.

Referring now to FIG. 6, there is shown a simple means for removing and re-inserting the battery for each of the die. Thus, for the first die 10 there is shown a removable container 27 one flat surface of which defines one of the surfaces of the die when the container is in place.

Container 27 in turn provides an access opening 28 for a battery pack 29. In addition, the one flat surface of the container includes a manually operable master switch means 30 for connecting and disconnecting the battery in the battery pack to the various gravity responsive switches in the die.

Figure 7:
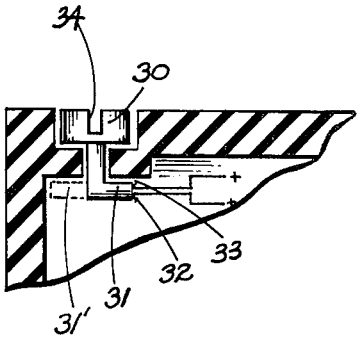
FIG. 7 is a fragmentary enlarged cross section taken in the direction of the arrows 7—7 of FIG. 6.

The aforesaid master switch is shown in greater detail in FIG. 7 wherein the same takes the form of a rotatable button member 30 having an inwardly and laterally extending arm 31 arranged to bridge a pair of spring contacts 32 and 33 when in the solid line position shown. This switch button 30 may be rotated as by means of inserting a fingernail in a top slot 34 thereof or any other suitable instrument and simply rotating the same 180° to remove the lateral bridging portion 31 to the dotted line position 31′ thereby opening up the spring leads 32 and 33.

Figure 8:
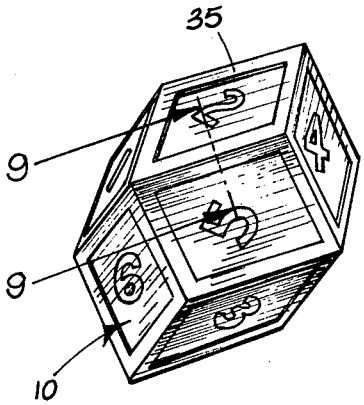
FIG. 8 is a perspective view of one of the die incorporating special vertice and edge linings; and, FIG. 9 is an enlarged fragmentary cross section taken in the direction of the arrows 9—9 of FIG. 8.

Referring now to FIG. 8, there is shown the die 10 slightly modified by the provision of a lining 35 along its edges and covering its vertices.

Figure 9:
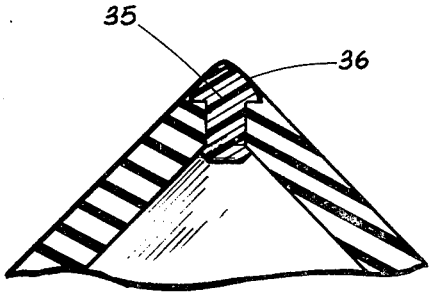

Referring particularly to the cross section of FIG. 9, the lining is shown at the vertex 36 of the die.

Essentially, the coating 35 defines a friction lining extending over the vertices and edges of each of the dies in inhibit the tendency for the dice to slide when thrown.

From the foregoing description, the operation of the dice will be evident. With appropriate fresh batteries positioned within the dice and the manually operable master switch 30 described in FIG. 7 in its solid line position to bridge the connections between the battery and the various gravity responsive switches, when the dice are thrown and come to rest only the topmost surface of each die will be illuminated. Thus there is no ambiguity as to which of the symbols are to be read off after the dice have come to rest. Furthermore, because there are provided twelve surfaces on each die, many more combinations of the displayed symbols can be realized, thereby greatly expanding the versatility of many games.

When the dice are not in use, but simply resting on a flat surface, it is preferably to operate the master switch 30 described in FIG. 7 to disconnect the battery from all of the gravity responsive switches so that there will be no drain thereon.

I claim:

1. Dice including, in combination:
   (a) first and second die each having a plurality of surfaces in which opposite surfaces lie in parallel planes;
   (b) light emitting means associated with each surface in each die; and
   (c) energizing means for said light emitting means in each die, said energizing means including a battery in each die and gravity responsive switch means for connecting said battery to that light emitting means associated with said surface assuming a topmost position after the die has been thrown and comes to rest.

2. Dice according to claim 1, in which the number of surfaces on each die is at least six.

3. Dice including, in combination:
   (a) first and second die, each having twelve flat congruent surfaces in which opposite surfaces lie in parallel planes;
   (b) twelve individual illuminating means inside each die disposed respectively adjacent to said twelve surfaces, such that when any one illuminating means is energized, the adjacent surface thereto is illuminated;
   (c) a source of energy in each die for energizing said illuminating means; and
   (d) gravity responsive switch means in each die connected between said source of energy and said illuminating means for energizing only that illuminating means adjacent to that surface of each die assuming a topmost position after the die has been thrown and comes to rest on a flat surface.

4. Dice according to claim 3 in which each of said illuminating means comprises a light emitting diode, said source of energy comprising a battery and in which each surface of each die is translucent; and mask means defining a symbol for each surface visible therethrough when the illuminating means adjacent to said surface is energized.

5. Dice according to claim 3, in which the outline of each of the twelve surfaces of said first die is a rhombus and in which the outline of each of the twelve surfaces of said second die is a pentagon.

6. Dice according to claim 3, in which each die includes a removable container having one flat side surface defining one surface of the die when the container is in place; and a battery pack in turn insertable into and removable from said container and incorporating said battery whereby said battery can be easily replaced in said die.

7. Dice according to claim 6, in which a corner portion of said one flat side surface includes manually operable master switch means for connecting and disconnecting said battery to said gravity responsive switch means.

8. Dice according to claim 3, including a friction lining extending over the vertices and edges of each of said dice to inhibit the tendency for said dice to slide when thrown.

* * * * *